US007771234B2

(12) United States Patent
Chuang

(10) Patent No.: US 7,771,234 B2
(45) Date of Patent: Aug. 10, 2010

(54) USB ELECTRIC CONNECTOR FOR TRANSFERRING DATA BETWEEN COMPUTERS

(76) Inventor: Yi-Fang Chuang, 5F., No. 15, Lane 117, Sec. 4, Sanhe Rd., Sanchong City, Taipei County 241 (TW)

( * ) Notice: Subject to any disclaimer, the term of this patent is extended or adjusted under 35 U.S.C. 154(b) by 0 days.

(21) Appl. No.: 12/418,748

(22) Filed: Apr. 6, 2009

(65) Prior Publication Data

US 2010/0003853 A1 Jan. 7, 2010

(30) Foreign Application Priority Data

Jul. 4, 2008 (TW) ..... 97211915 U

(51) Int. Cl.
*H01R 13/66* (2006.01)

(52) U.S. Cl. ..... 439/607.22

(58) Field of Classification Search ..... 439/607.22, 439/495, 497, 492

See application file for complete search history.

(56) References Cited

U.S. PATENT DOCUMENTS

| | | | | |
|---|---|---|---|---|
| 7,661,988 | B1 * | 2/2010 | He et al. | 439/607.32 |
| 7,677,918 | B1 * | 3/2010 | Huang et al. | 439/495 |
| 2009/0137151 | A1 * | 5/2009 | Tai et al. | 439/607.22 |
| 2009/0186525 | A1 * | 7/2009 | Droesbeke et al. | 439/607.22 |

* cited by examiner

*Primary Examiner*—Jean F Duverne
(74) *Attorney, Agent, or Firm*—Chun-Ming Shih; HDLS IPR Services

(57) ABSTRACT

A (universal serial bus) USB electric connector for transferring data between computers includes an outer shell, a seat body, a terminal set, a bridge circuit board and a lid body. The outer shell has a hollow main body, in which a seat body is provided, on which a terminal set is disposed, one side of which is electrically connected to the bridge circuit board. The lid body is connected by sealing the bottom of the seat body. The electrically conductive legs on the bridge circuit board pass through the lid body and are electrically connected to the motherboard of an electronic device. By applying a USB electric connector for connecting two computers via a traditional USB transmission line, it is possible to inter-transfer data between two computers.

9 Claims, 4 Drawing Sheets

USB ELECTRIC CONNECTOR FOR TRANSFERRING DATA BETWEEN COMPUTERS

BACKGROUND OF THE INVENTION

1. Field of the Invention

The present invention in general relates to an electric connector, in particular, to a USB electric connector for transferring data between two computers.

2. Description of Prior Art

In an early period, when two computers execute a process of data transfer or backup, the electrically connecting ports (printer ports) of the two computers are connected via a transmission line. Therefore, the data of one computer can be transferred to the other one to achieve an object of transferring data between computers.

However, under the development of internet, every computer has a plugged-in or built-in LAN card provided for a user capable of connecting to each website directly through the internet, so the user at a using side can do a shopping at websites or communicate with faraway users. When a user has two computers, which need to transfer data to each other or make a data backup, it is possible to use a RJ45 network cable (crossover) directly connected to the RJ45 electric connectors of the LAN cards of both computers, making the data in one computer transferred to the other one. However, not the all network slots on the LAN card of computer are of RJ45 electric connector. So, in many occasions, it is impossible to make a data transmission between two computers.

Recently, since USB electric connector is comprehensively applied to each kind of electric appliance, in order to solve the aforementioned problems, the industries affix a bridge to the USB transmission line, whereby a bridge chip built in the bridge can manage a data transferring process. Therefore, when two computers are executing a data transfer to each other, the USB transmission line is only plugged in the USB electric connectors of two computers, making the data intertransferred between two computers become feasible. Although the USB transmission line having bridge can directly connect the USB electric connectors of two computers to undergo a data transmission, the cost of this kind of USB transmission is very high. In other words, the user has to pay extra money to pursue this kind of function.

Therefore, how to improve and solve the aforementioned problems is an issue intended to be addressed by the inventor.

Accordingly, after a substantially devoted study, in cooperation with the application of relatively academic principles, the inventor has finally proposed the present invention that is designed reasonably to possess the capability to improve the drawback of the prior art significantly.

SUMMARY OF THE INVENTION

The invention is mainly to provide a bridge chip built in a USB electric connector, such that a user can use a traditional USB transmission line to connect two computers, making a data transmission between these two computers become feasible.

Secondly, the invention is to provide a USB electric connector for data transmission between computers, including an outer shell, a seat body, a terminal seat, a bridge circuit board and a lid body. The outer shell has a hollow main body, at a front side of which an inserting slot is arranged, and adjoining to an end side and a bottom of which an opening is arranged. The seat body is disposed in the outer shell and has a stop wall at the front side thereof. The stop wall is extended a loading portion. A through hole provided for the terminal set to pass through is arranged on the stop wall. A hollow opening is arranged by adjoining to the rear side and the bottom part of the seat body. Two recesses corresponding to each other are arranged at two lateral walls of the seat body in the opening. The terminal set is comprised of a plurality of electrically conductive legs, one side of each of which is disposed on the loading portion, while another side is extended to an outside of the hollow opening. The bridge circuit board has a bridge chip for managing a data-transferring process. A plurality of inserting holes are arranged at one side of the bridge circuit board and are electrically connected to the electrically conductive legs extended to an outside of the hollow opening. Furthermore, another side of the bridge circuit board is arranged a plurality of electrically conductive pillars, which are electrically connected to a motherboard of an electric device. The lid body is connected by sealing the hollow opening. The electrically conductive pillars pass through the holes on the lid body and are electrically connected to the motherboard of the electric device.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

Figure 1:
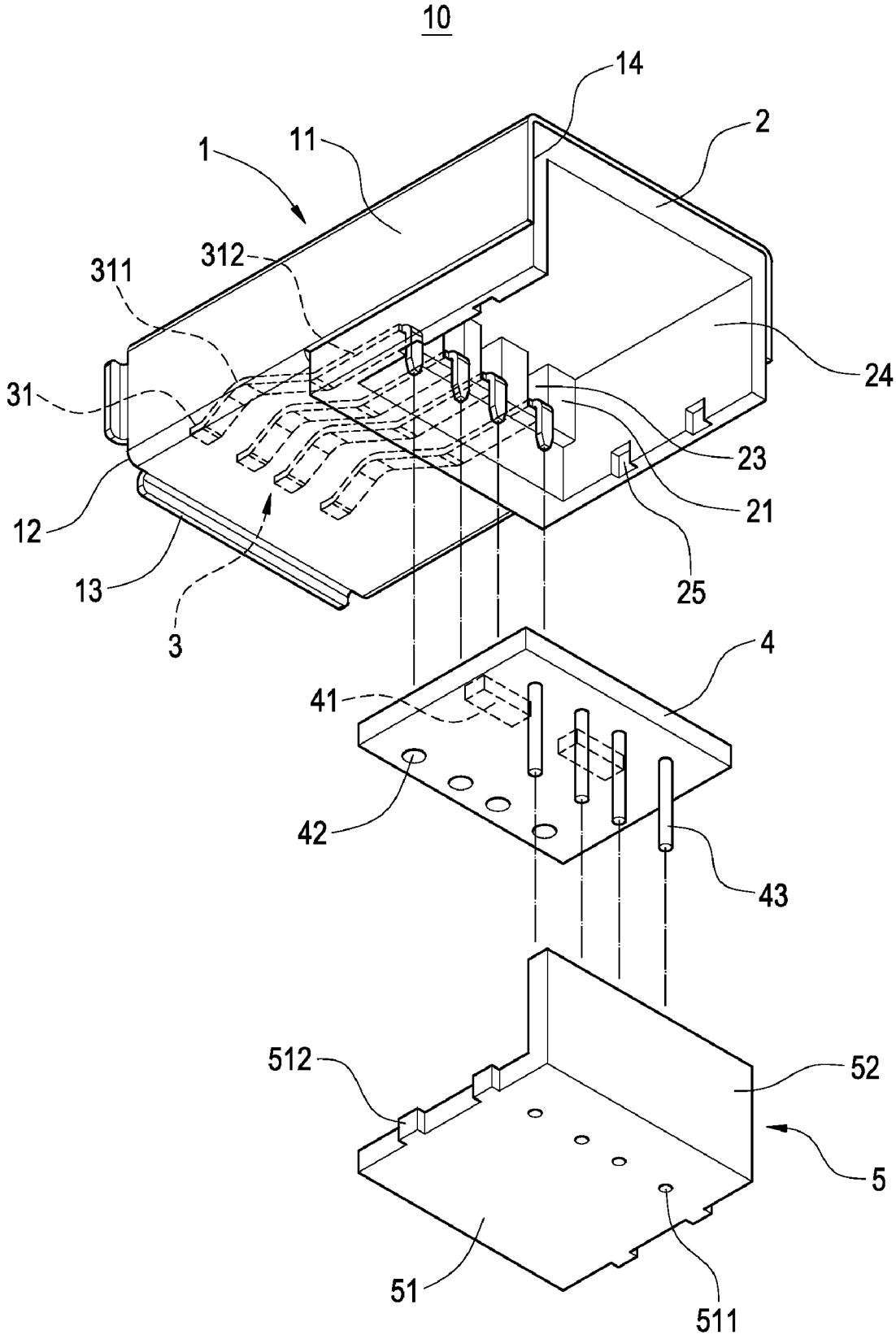
FIG. 1 is an explosive illustration of a compound connector of the present invention.
Figure 2:
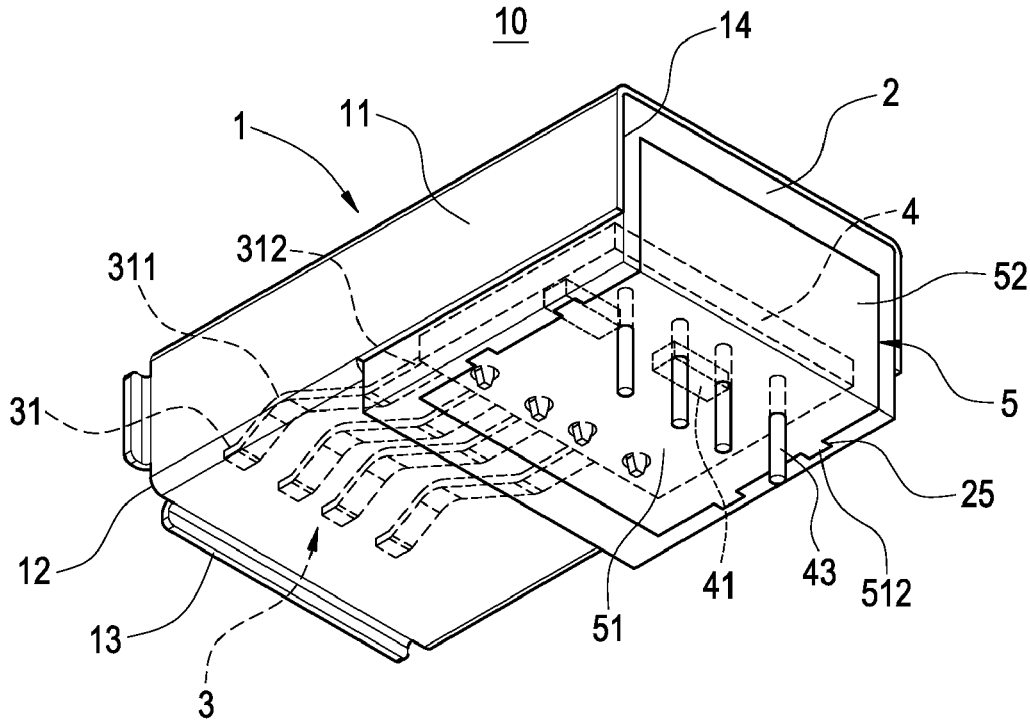
FIG. 2 is an upwardly viewed illustration of a compound connector of the present invention.
Figure 3:
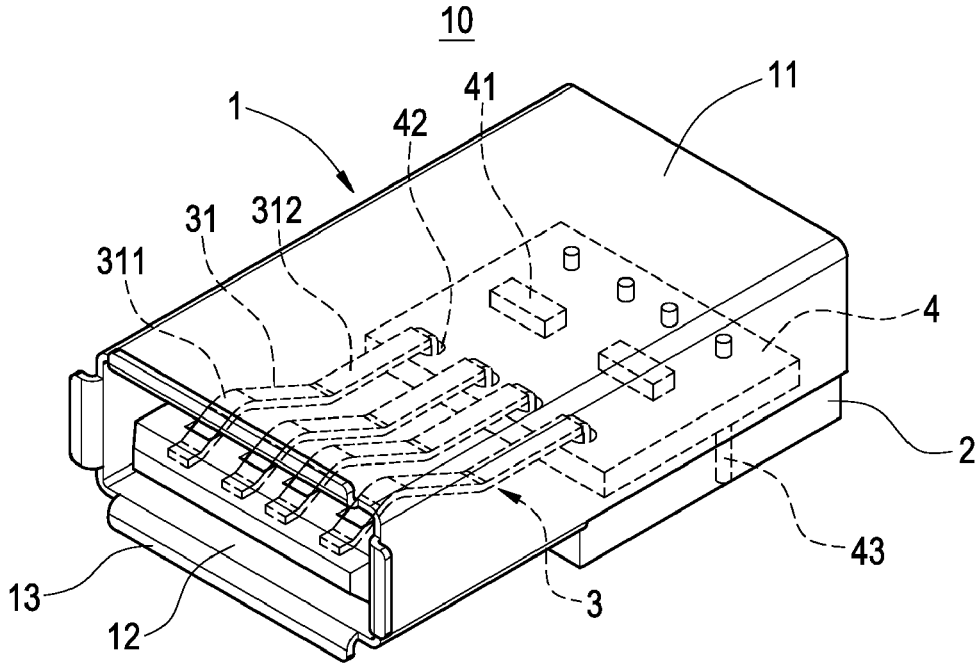
FIG. 3 is an assembled illustration of a compound connector of the present invention upwardly viewed from another angle.
Figure 4:
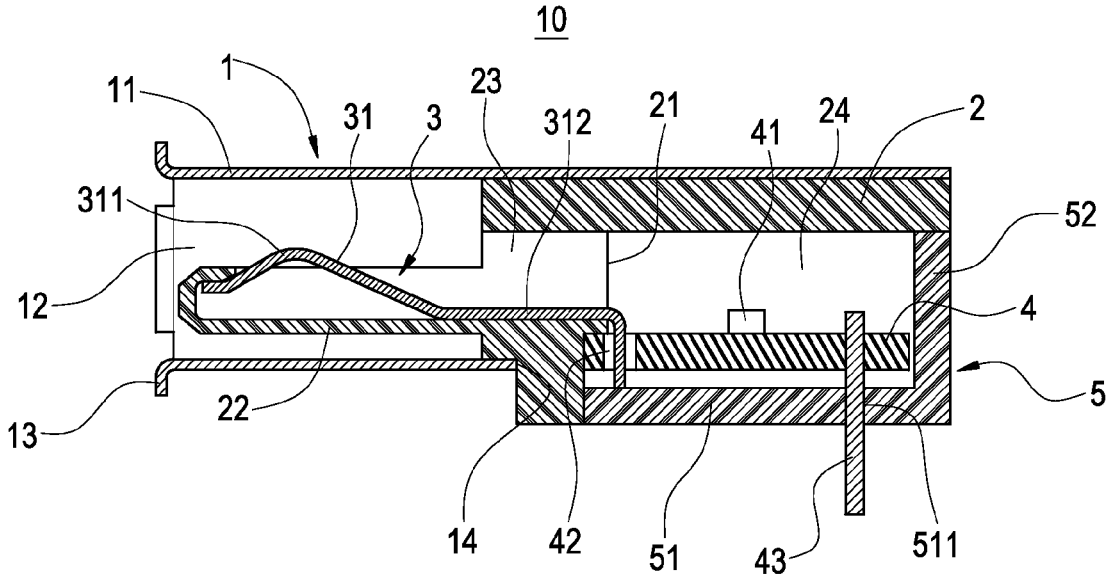
FIG. 4 is a cross-sectional illustration of a compound connector of the present invention.

In cooperation with attached drawings, the technical contents and detailed description of the present invention are described thereinafter according to a preferable embodiment, not used to limit its executing scope. Any equivalent variation and modification made according to appended claims is all covered by the claims claimed by the present invention.

Please refer to FIG. 1 through FIG. 4, separately showing an explosive illustration, an upwardly viewed illustration, an assembled illustration upwardly viewed from another angle and a cross-sectional illustration of a compound connector of the present invention. The USB electric connector 10 includes an outer shell 1, a seat body 2, a terminal set 3, a bridge circuit board 4 and a lid body 5.

In the outer shell 1, a hollow main body 11 made of a metallic material has an inserting slot 12 at a front side thereof. The circumferential edges of the inserting slot 12 are connected by a plurality of arc stop pieces 13. An opening 14 is arranged by adjoining an end side and a bottom of the hollow main body 11.

The seat body 2 made of a plastic material is disposed in the outer shell 1. A front side of the seat body 2 is arranged a stop wall 21 extended a loading portion 22. A through hole 23 provided for the terminal set 3 to pass through is arranged on the stop wall 21, making one side of the electrically conductive leg 3 extended on the loading portion 22. In addition, a hollow opening 24 is arranged by adjoining a rear side and a bottom part of the seat body 2. Two corresponding recesses 25 are arranged at two lateral walls of the seat body 2 in the hollow opening 24.

The terminal set 3 is comprised of a plurality of electrically conductive legs 31, each of which has a first section 311 and a second section 312. The first section 311 shown as an arc shape is disposed on the loading portion 22, while the second section 312 shown as an "L" shape is disposed in the through hole 23. One side of the first section 312 is extended to an outside of the hollow opening 24.

A bridge chip 41 arranged on the bridge circuit board 4 is provided for processing a data transmission. A plurality of inserting holes 42 arranged at one side of the bridge circuit board 4 are provided for inserting one side of the second section 312 therein. After being inserted, the second section 312 is electrically connected to the bridge circuit board 4. Another side of the bridge circuit board 4 is arranged a plurality of electrically conductive pillars 43 provided for an electric connection to the motherboard of an electronic device (not shown).

The lid body 5 shown as an "L" shape is made of a plastic material and is comprised of a first lid plate 51 and a second lid plate 52. A plurality of holes 511 arranged on the first lid plate 51 are provided for the electrically conductive pillars 43 to pass through. A convex block 512 jointed with the recess 25 is respectively arranged at two lateral sides of the first lid plate 51. When the lid body 5 is assembled to the hollow opening 24, the electrically conductive pillar 43 passes through the hole 511 on the first lid plate 51, making the convex blocks 512 at two lateral sides of the first lid plate 51 jointed with the recesses 25.

Figure 5:
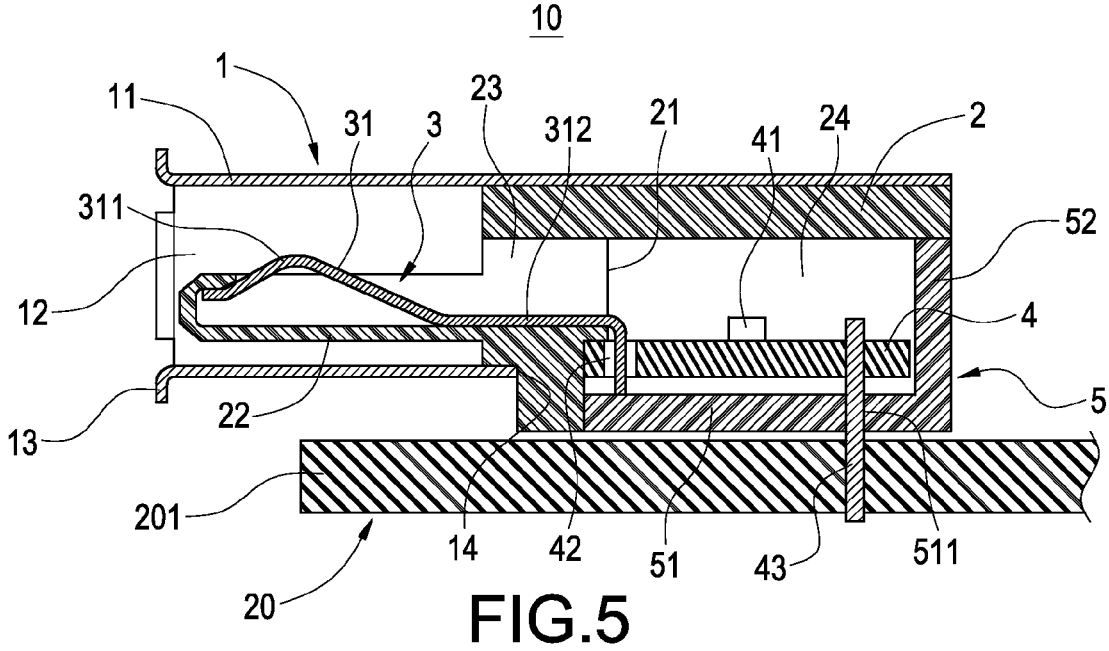
FIG. 5 is a using status illustration of a USB electric connector of the present invention.

Please refer to FIG. 5, showing a using status illustration of a USB electric connector of the present invention. As shown in this figure, when using a USB electric connector of the invention, the electrically conductive pillars 43 are electrically connected with the motherboard 201 of the computer 20. Since the USB electric connector 10 electrically connected to the motherboard 201 of the computer 20 has a bridge circuit board 4 capable of data transformation, the data transmission between computers is thus feasible.

Figure 6:
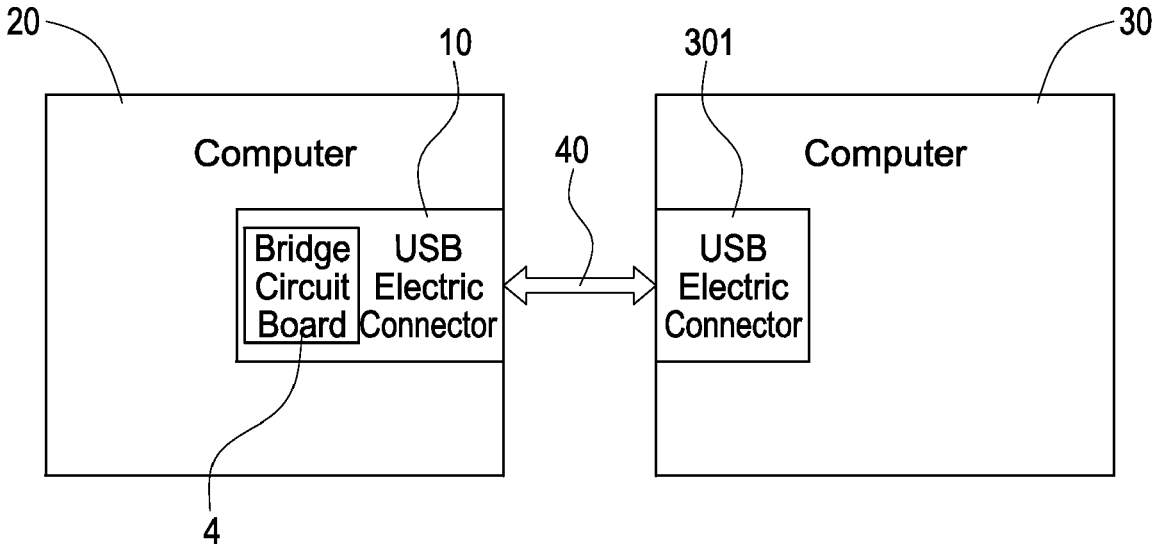
FIG. 6 is an illustration of two computers connected to undergo a data transmission in accordance with the present invention.

Please refer to FIG. 6, showing an illustration of two computers connected to undergo a data transmission in accordance with the present invention. As shown in this figure, the electric connector of the first computer is a USB electric connector 10 according to the present invention, while the USB electric connector 301 of the second computer 30 is a traditional one. When the first computer 20 is transferring data to the second computer 30, the USB electric connectors 10, 301 may be electrically connected via a traditional USB transmission cable 40. More specifically, after the data sent out from the first computer 20 has been processed by the bridge circuit board 4, the data is transferred to the second computer 30 and stored therein. Similarly, after the data sent out from the second computer 30 has been transferred to the USB electric connector 10, the data is processed by the bridge circuit board 4, then, transferred to the first computer 20 and stored therein. Thus, a data transmission between two computers is thereby achieved.

Summarizing aforementioned description, the USB electric connector according to the invention is an indispensably novel device for a data transmission between two computers indeed, which may positively reach the expected usage objective for solving the drawbacks of the prior arts, and which extremely possesses the innovation and progressiveness to completely fulfill the applying merits of new type patent, according to which the invention is thereby applied. Please examine the application carefully and grant it as a formal patent for protecting the rights of the inventor.

However, the aforementioned description is only a preferable embodiment according to the present invention, not used to limit the patent scope of the invention, so equivalently structural variation made to the contents of the present invention, for example, description and drawings, is all covered by the claims claimed thereinafter.

What is claimed is:

1. A USB electric connector disposed on a motherboard of an electronic device for data transmission between computers, including:

an outer shell, which has a hollow main body therein, at a front side of which an inserting slot is arranged, and adjoining to an end side and a bottom of which an opening is arranged;

a seat body, which is disposed in the outer shell, and adjoining to a rear side and a bottom part of which a hollow opening is arranged;

a terminal set, which is comprised of a plurality of electrically conductive legs, one side of each of which is disposed on loading portion, while another side is extended to an outside of the hollow opening; and a bridge circuit board, which is electrically connected to the plural electrically conductive legs extended through the hollow opening, wherein a stop wall is arranged at a front side of the seat body and extended a loading portion, and a plurality of through holes are arranged at the stop wall for the terminal set to pass through, making one side of the electrically conductive leg of the terminal set extended on the loading portion, while two corresponding recesses are arranged at two lateral sides of the hollow opening.

2. The USB electric connector according to claim 1, wherein the outer shell is made of a metallic material.

3. The USB electric connector according to claim 1, wherein a plurality of arc stop pieces are connected around circumferential edges of the inserting slot.

4. The USB electric connector according to claim 1, wherein the seat body is made of a plastic material.

5. The USB electric connector according to claim 1, wherein the electrically conductive leg is comprised of a first section and a second section, and the first section shown as an arc shape is disposed on the loading portion, while the second section shown as an "L" shape is disposed in the through hole.

6. The USB electric connector according to claim 1, wherein the bridge circuit board has a bridge chip thereon, and one side of the bridge circuit board is arranged a plurality of inserting holes separately provided for inserting a side of a second section the electrically conductive leg therein to be electrically connected to the bridge circuit board, while another side of the bridge circuit board is arranged a plurality of electrically conductive pillars provided for being electrically connected to the motherboard.

7. The USB electric connector according to claim 1, wherein a lid body further included is shown as an "L" shape, which is made of a plastic material and comprised of a first lid plate and a second lid plate, and a plurality of holes are arranged on the first lid plate for a plurality of electrically conductive pillars of the bridge circuit board to pass through, and a convex block is respectively arranged at two lateral sides of the first lid plate for being jointed to a recess.

8. A USB electric connector disposed on a motherboard of an electronic device for data transmission between computers, including:

an outer shell, which has a hollow main body therein, at a front side of which an inserting slot is arranged, and adjoining to an end side and a bottom of which an opening is arranged;

a seat body, which is disposed in the outer shell, and adjoining to a rear side and a bottom part of which a hollow opening is arranged;

a terminal set, which is comprised of a plurality of electrically conductive legs, one side of each of which is disposed on loading portion, while another side is extended to an outside of the hollow opening; and a bridge circuit board, which is electrically connected to the plural electrically conductive legs extended through the hollow opening, wherein the bridge circuit board has a bridge chip thereon, and one side of the bridge circuit board is arranged a plurality of inserting holes separately provided for inserting a side of a second section the electrically conductive leg therein to be electrically connected to the bridge circuit board, while another side of the bridge circuit board is arranged a plurality of electrically conductive pillars provided for being electrically connected to the motherboard.

9. A USB electric connector disposed on a motherboard of an electronic device for data transmission between computers, including:

an outer shell, which has a hollow main body therein, at a front side of which an inserting slot is arranged, and adjoining to an end side and a bottom of which an opening is arranged;

a seat body, which is disposed in the outer shell, and adjoining to a rear side and a bottom part of which a hollow opening is arranged;

a terminal set, which is comprised of a plurality of electrically conductive legs, one side of each of which is disposed on loading portion, while another side is extended to an outside of the hollow opening; and a bridge circuit board, which is electrically connected to the plural electrically conductive legs extended through the hollow opening, wherein a lid body further included is shown as an "L" shape, which is made of a plastic material and comprised of a first lid plate and a second lid plate, and a plurality of holes are arranged on the first lid plate for a plurality of electrically conductive pillars of the bridge circuit board to pass through, and a convex block is respectively arranged at two lateral sides of the first lid plate for being jointed to a recess.

* * * * *